United States Patent [19]

Christensen

[11] Patent Number: 4,863,059

[45] Date of Patent: Sep. 5, 1989

[54] UTILITY BOX CONSTRUCTION AND RING THEREFOR

[75] Inventor: Thomas E. Christensen, Fremont, Calif.

[73] Assignee: Christy Concrete Products, Inc., Fremont, Calif.

[21] Appl. No.: 204,875

[22] Filed: Jun. 10, 1988

[51] Int. Cl.[4] ..... B65D 1/22; B65D 1/48

[52] U.S. Cl. ..... 220/73; 220/3.8

[58] Field of Search ..... 220/73, DIG. 3, 430, 220/3.8, 3.2, 74, 354; 52/169.7, 58, 62

[56] References Cited

U.S. PATENT DOCUMENTS

| | | | |
|---|---|---|---|
| 1,213,478 | 1/1917 | Haase | 220/3.8 |
| 1,537,600 | 7/1924 | Grogan | 220/73 |
| 2,370,034 | 2/1945 | Haugland | 220/430 |
| 4,048,766 | 9/1977 | Dantzer et al. | 220/74 |
| 4,318,254 | 3/1982 | Stegmeier | 52/169.7 |
| 4,408,420 | 10/1983 | Haase | 52/169.7 |

FOREIGN PATENT DOCUMENTS

| | | | |
|---|---|---|---|
| 0139239 | 10/1979 | Japan | 52/169.7 |

*Primary Examiner*—Stephen Marcus
*Assistant Examiner*—Stephen Castellano
*Attorney, Agent, or Firm*—Flehr, Hohbach, Test, Albritton & Herbert

[57] ABSTRACT

Utility box construction having an enclosure formed of concrete with an opening in its top side. A ring-like protective cap formed of plastic is mounted in the concrete enclosure and circumscribes the opening. The ring-like cap has a side wall, a continuous outwardly extending rim formed integral with the upper extremity of the side wall and a continuous inwardly extending rim formed integral with the lower extremity of the side wall. The side wall has formed integral therewith vertically extending spaced apart rib portions which are tapered inwardly into the opening as they extend downwardly. The inwardly extending rim having vertically extending horizontally disposed rib portions in alignment with the rib portions on the side walls. An upstanding lip is formed integral with the inwardly extending rim. The upstanding lip extends parallel to but is spaced from the side wall.

6 Claims, 1 Drawing Sheet

UTILITY BOX CONSTRUCTION AND RING THEREFOR

This invention relates to a utility box construction and a ring therefor.

DESCRIPTION OF PRIOR ART

Such utility boxes have heretofore been provided with reinforcing rings. By way of example, as illustrated in a catalog sheet of Christy Concrete Products, Inc. of Fremont, Calif. 94538, there has been provided several utility box constructions which utilize a reinforcing ring having an etched polyethylene face and which incorporate an ultraviolet inhibitor. Although this utility box construction has been available for a number of year, deficiencies have arisen with respect to this utility box construction. For example, it has been found that it is difficult to slide the concrete lids on the box because they have a tendency to hang up on the ribs. In addition it has been found that the rib construction heretofore utilized traps water which turns into ice and which has a tendency to freeze the lid into the box to make it difficult to remove the lid during cold weather. There is therefore a need for a new and improved utility box construction which eliminates these difficulties.

OBJECTS OF THE INVENTION

In general, it is an object of the present invention to provide a utility box construction and a ring therefor which facilitates insertion of the lid into the box.

Another object of the invention is to provide a utility box construction of the above character which facilitates removal of the lid in the event there is a collection of water which freezes in the ring of the box.

Another object of the invention is to provide a utility box construction of the above character in which additional reinforcing has been provided for the ring to increase the strength of the rim and also to facilitate securing the ring to the box.

Additional objects and features of the invention will appear from the following description in which the preferred embodiment is set forth in detail in conjunction with the accompanying drawing.

DETAILED DESCRIPTION OF THE PREFERRED EMBODIMENTS

Figure 1:
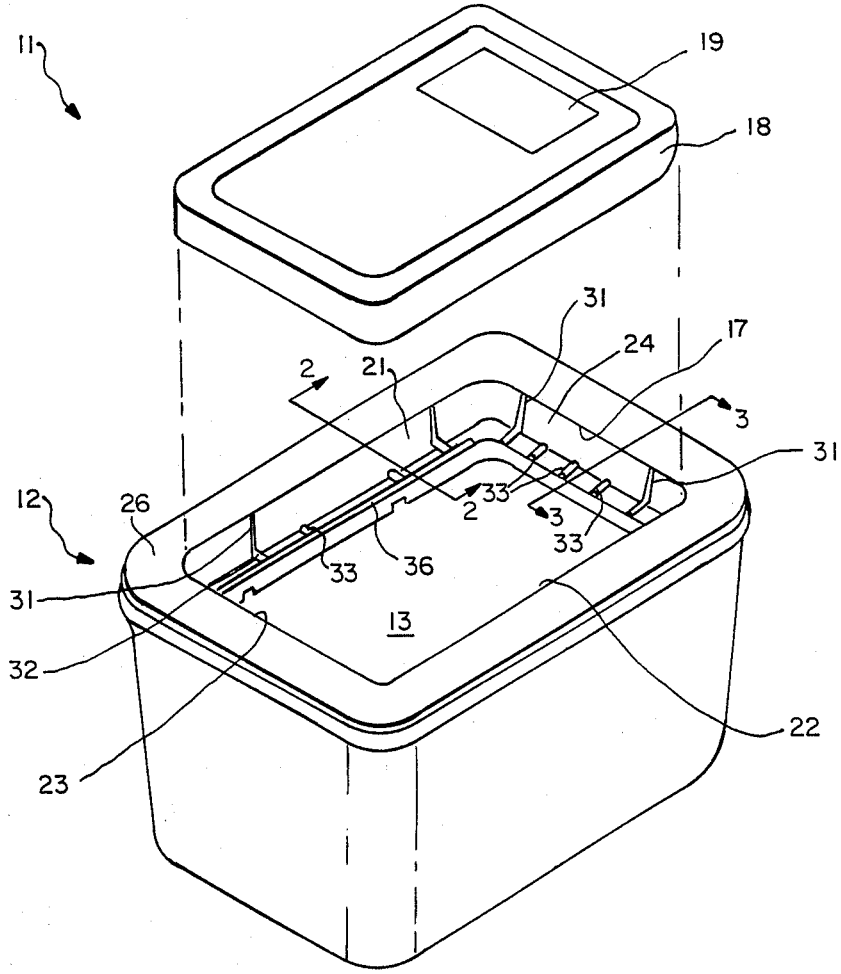
FIG. 1 is an exploded view showing a utility box construction incorporating the present invention with the lid in an elevated position.

In general the utility box construction of the present invention is formed of an enclosure and a lid. The enclosure is formed of concrete and is provided with an upwardly facing opening in the top side. Generally the utility box has an open bottom side. A ring-like protective cap is formed of plastic and is embedded in the concrete enclosure and circumscribes the rectangular opening of the enclosure. The ring-like cap has spaced parallel side walls and spaced parallel end walls extending at substantially right angles to the side walls. A continuous outwardly extending rim is formed integral with the upper extremity of the side and end walls. A continuous inwardly extending rim is formed integral with the lower extremities of the side and end walls. Each of the side and end walls have formed integral therewith vertically extending spaced apart parallel ribbed portions inwardly and downwardly. The inwardly extending rim has formed integral therewith upstanding spaced apart parallel horizontally extending ribbed portions adjoining the ribbed portions integral with the side and end walls and an upstanding lip formed integral with an inwardly extending rim adjacent to but spaced from the side wall portions extending longitudinally of the side wall portions. The height of the upstanding lip is at least slightly greater than the height of the horizontally extending ribs provided on the inwardly extending rim. The ring-like cap is also provided with reinforcing elements which extend into the concrete and firmly secure the cap to the concrete enclosure.

More specifically as shown in the drawings, the utility box construction 11 is comprised of an enclosure 12 formed of a suitable material such as concrete. The enclosure can be rectangular as shown. It should be appreciated that other configurations such as circular can be utilized. The enclosure 12 is provided with a bottom rectangular open end 13 and a top rectangular open end 14. A ring-like protective cap 16 is mounted on the enclosure 12 and circumscribes the top opening 14 therein. The cap 16 is formed of a suitable plastic such as polyethylene. The ring-like protective cap 16 is provided with a rectangular recess 17 which is adapted to receive a lid 18 formed of a suitable material such as concrete. The lid 18 is provided with a hinged cover or lid 19 which is adapted to be swung to an open position to permit viewing of the interior of the utility box construction 11.

The ring-like protective cap 16 is provided with spaced parallel vertical side walls 21 and 22 and spaced parallel vertical end walls 23 and 24 which extend at substantially right angles to the side walls 21 and 22. The ring-like protective cap is also provided with a continuous outwardly extending rim 26 which is formed integral with the upper extremities of the side walls 21 and 22 and end walls 23 and 24 and extends in generally a horizontal plane. The exposed surface of the rim 26 can be etched to provide a textural appearance. A downwardly depending lip 27 is provided on the outer extremity of the rim 26 and is formed integral with the rim 26. A continuous inwardly extending rim 29 is provided at the lower extremities of the side walls 21 and 22 and the end walls 23 and 24 and is formed integral therewith. The inwardly extending rim 29 lies in a generally horizontal plane parallel to the outwardly extending rim 26.

Each of the side walls 21 and 22 and each of the end walls 23 and 24 is provided with first and second spaced apart and parallel upstanding lid centering rib portions 31 which are tapered inwardly into the opening 14 as they extend downwardly. The inwardly extending rim 29 is provided with upwardly and horizontally extending rib portions 32 which are aligned with the rib portions 31. Additional spaced and parallel rib portions 33 are provided between the rib portions 32 and extend upwardly to have their upper surfaces lie in a horizontal plane. Thus there has been provided two of such rib portions 32 on each of the side walls between the rib portions 31 and three of such rib portions 33 between the two rib portions 31.

Figure 2:
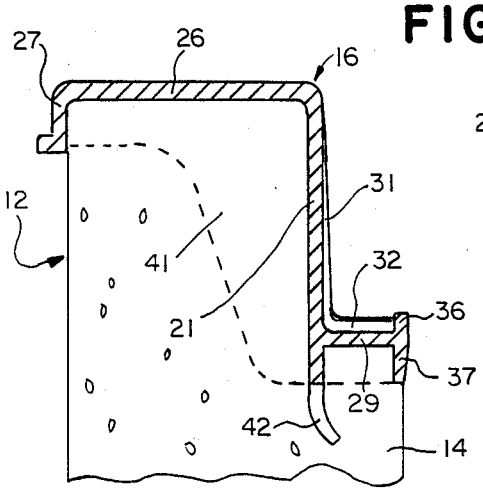
FIG. 2 is a cross sectional view taken along the line 2—2 of FIG. 1.
Figure 3:
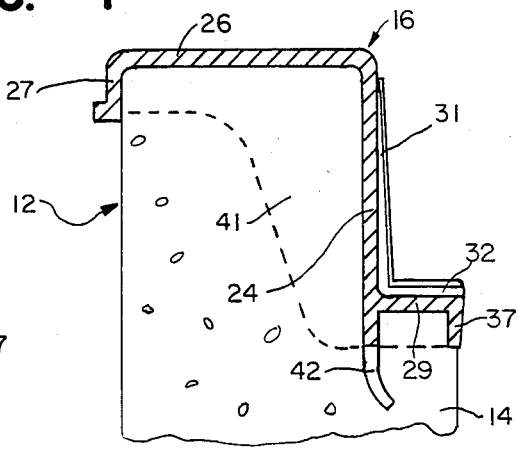
FIG. 3 is a cross sectional view taken along the line 3—3 of FIG. 1.

An upwardly extending rib or lip 36 is formed integral with the inwardly extending rim 29 which extends upwardly and longitudinally of the side walls 21 and 22. As can be seen particularly in FIG. 2, the rib or lip 36 has a height which is at least slightly greater than the height of the rib portions 32 and the rib portions 33. A downwardly extending lip 37 is provided at the outer extremity of the inwardly extending rim 29 and is formed integral therewith. As shown in FIG. 2, this downwardly extending lip 37 is in alignment with the rib or lip 36.

The ring-like protective cap 16 is provided with means which facilitates bonding of the cap 16 to the enclosure 12. Such means consists of spaced apart reinforcing webs 41 which are spaced longitudinally of the rim 26 and which are adapted to seat within the concrete to form a frictional bond therewith. In addition there are provided spaced apart downwardly extending fingers 42 which are slightly arcuate and which are of a suitable length, as for example, one half of an inch which extend downwardly into the concrete enclosure and form a further bond therewith. Two of the fingers 42 are provided on each of the side walls and one finger is provided on each of the end walls.

An ultraviolet inhibitor can be incorporated in the plastic cap 16 to increase its durability where exposed to sunlight.

Use of the utility box construction 11 may now be briefly described as follows. Let it be assumed that the utility box is used in a conventional application, as for example, enclosing a water meter for a private residence. The utility box is seated in a convention manner at a suitable elevation. After it has been placed in position, the lid 18 can be inserted into the recess 17 by sliding the lid into the recess. This can be readily accomplished because the lid will engage the upstanding rib or lip 36 which, since they are higher than the rib portions 32 and 33, will permit the lid to be readily slid into place in the recess 17. The tapering of the ribs 31 also facilitate centering and seating of the lid within the recess 17. The tapered rib portions 31 serve to prevent the lid 18 from moving all the way to one side which could cause a gap to occur between the lid and the box that could create a tripping hazard. Also the tapered rib portions 31 make it possible for the enclosure to accommodate some variations in lid sizes. In the event that water collects between the inwardly extending rim 29, the water will flow over the rib portions 32 and 33 to the ends and then drain down the interior of the box. The level of the water always will be below the lower surface of the lid 18. Therefore in the event of the freezing of the water, the lid should not be frozen into the box. The upstanding rib portions 33 extend above any ice which may be formed within the pockets between the lip or rib 36 and the rib portions 32 and 33. This facilitates the removal of lids from boxes during freezing weather.

The box construction is also such that the caps are securely retained on the concrete enclosure by the fingers 42 and the webs 41. The plastic cap serves to prevent slipping of the concrete enclosure 12 as well as the lid 18.

What is claimed is:

1. In a utility box construction, an enclosure formed of concrete having an opening in its top side, a ring-like protective cap formed of plastic and mounted in the concrete enclosure and circumscribing the opening, said ring-like cap having side walls, end walls, and a continuous outwardly extending rim formed integral with the upper extremities of the side walls and end walls, a continuous inwardly extending rim formed integral with the lower extremity of the side walls and end walls, said side walls having formed integral therewith vertically extending spaced apart rib portions which are tapered inwardly into the opening as they extend downwardly, the inwardly extending rim having horizontally extending rib portions in alignment with the rib portions on the side walls, and an upstanding lip formed integral with the inwardly extending rim, said upstanding lip extending parallel to but being spaced from the side walls.

2. A utility box construction as in claim 1, together with a lid seated within the ring-like protective cap, the lid resting upon the upstanding lip formed integral with the inwardly extending rim and being spaced above the horizontally extending rib portions, the lid being centered in the opening by the vertically extending spaced apart rib portions.

3. A utility box construction as in claim 1 together with additional horizontally extending rib portions formed integral with the inwardly extending rim and having a height less than the height of the upstanding lip.

4. A box construction as in claim 1 together with means formed integral with the ring-like protective cap and extending into the concrete to form a secure bond therewith.

5. A utility box construction as in claim 4 wherein said means consists of spaced apart fingers extending downwardly and outwardly from the side walls and into the concrete of the enclosure.

6. A utility box construction as in claim 5 together with webs formed integral with the ring-like cap extending into the concrete.

* * * * *